US009492836B2

(12) United States Patent
Wang et al.

(10) Patent No.: US 9,492,836 B2
(45) Date of Patent: Nov. 15, 2016

(54) COATING MODULE

(71) Applicant: National Taiwan University, Taipei (TW)

(72) Inventors: An-Bang Wang, Taipei (TW); Yu-Wen Hsieh, Taipei (TW); Yu-Ju Liu, Taipei (TW)

(73) Assignee: National Taiwan University, Taipei (TW)

( * ) Notice: Subject to any disclaimer, the term of this patent is extended or adjusted under 35 U.S.C. 154(b) by 183 days.

(21) Appl. No.: 13/762,378

(22) Filed: Feb. 8, 2013

(65) Prior Publication Data

US 2014/0000511 A1 Jan. 2, 2014

(30) Foreign Application Priority Data

Jun. 29, 2012 (TW) ..... 101123480 A

(51) Int. Cl.
*B05C 1/00* (2006.01)
*B05C 5/00* (2006.01)
*B05C 5/02* (2006.01)

(52) U.S. Cl.
CPC ..... *B05C 5/00* (2013.01); *B05C 5/0254* (2013.01); *B05C 5/0262* (2013.01)

(58) Field of Classification Search
None
See application file for complete search history.

(56) References Cited

U.S. PATENT DOCUMENTS

| | | | | |
|---|---|---|---|---|
| 2,916,012 | A | 12/1959 | Hergenrother | |
| 3,570,725 | A | 3/1971 | Baker et al. | |
| 3,825,379 | A | 7/1974 | Lohkamp et al. | |
| 4,220,114 | A | 9/1980 | Radowicz | |
| 4,299,186 | A | 11/1981 | Pipkin et al. | |
| 4,358,332 | A * | 11/1982 | Rodish | 156/356 |
| 4,445,458 | A * | 5/1984 | O'Brien | 118/401 |
| 4,774,109 | A | 9/1988 | Hadzimihalis et al. | |
| 5,547,094 | A * | 8/1996 | Bartels et al. | 216/33 |

(Continued)

FOREIGN PATENT DOCUMENTS

| | | |
|---|---|---|
| JP | H08501979 | 3/1996 |
| JP | 2001-029860 | 2/2001 |

(Continued)

OTHER PUBLICATIONS

"Office Action of Korea Counterpart Application" with English translation thereof, issued on May 21, 2014, p. 1-p. 9.

(Continued)

*Primary Examiner* — Dah-Wei D Yuan
*Assistant Examiner* — Jethro M Pence
(74) *Attorney, Agent, or Firm* — Jianq Chyun IP Office

(57) ABSTRACT

A coating module is suitable to coat a liquid onto a substrate and includes two plates and a diversion structure, in which there is a slot between the plates, and the slot has a slot inlet and a slot outlet, and one of the plates has an injecting port. The diversion structure makes the injecting port communicated with the slot inlet, in which the liquid is configured to enter the diversion structure via the injecting port, and flow to the slot inlet through the diversion structure, then flow into the slot via the slot inlet and then outflows from the slot via the slot outlet to be coated onto the substrate.

15 Claims, 15 Drawing Sheets

100

(56) References Cited

U.S. PATENT DOCUMENTS

| | | | | |
|---|---|---|---|---|
| 2004/0256496 | A1 | 12/2004 | Harris et al. | |
| 2005/0184086 | A1* | 8/2005 | Raterman et al. | 222/1 |
| 2006/0062899 | A1 | 3/2006 | Rankin, Jr. et al. | |
| 2012/0219657 | A1 | 8/2012 | Kondo | |

FOREIGN PATENT DOCUMENTS

| | | |
|---|---|---|
| JP | 2001-507987 | 6/2001 |
| JP | 2002-103361 | 4/2002 |
| JP | 2002096474 | 4/2002 |
| JP | 2003-200444 | 7/2003 |
| JP | 2004-283820 | 10/2004 |
| JP | 2004-314053 | 11/2004 |
| JP | 2004-330094 | 11/2004 |
| JP | 2006015210 | 1/2006 |
| JP | 2006310235 | 11/2006 |
| JP | 2007136454 | 6/2007 |
| JP | 2009-513365 | 4/2009 |
| JP | 2009-202141 | 9/2009 |
| TW | 358969 | 5/1999 |
| TW | 517011 | 1/2003 |
| TW | I250045 | 3/2006 |

OTHER PUBLICATIONS

"Search Report of Europe Counterpart Application" with Applicant's comments thereof, issued on Aug. 6, 2013, p. 1-p. 6.

Thierry G. Charbonneaux, "Design of Sheet Dies for Minimum Residence Time Distribution: A Review," Polymer-Plastics Technology and Engineering 30(7), Oct. 1991, pp. 665-684.

Liu et al., "Development of a Novel Slot Die Coater Manufacturing Technology and its Application for Multilayer ceramic capacitor (MLCC)," 7th International Microsystems, Packaging, Assembly and Circuits Technology Conference (IMPACT), Oct. 2012, pp. 1-4.

Wang et al, Abstract of "Could a Die Be Disposable?—Design and Test of a Silicon-Wafer-Based Slot Die Coater," 16th International Coating Science and Technology Symposium, Sep. 9-12, 2012, p. 1.

"Office Action of Taiwan Counterpart Application", issued on Nov. 21, 2014, p. 1-p. 5.

"Notice of Allowance of Japan Counterpart Application", issued on Oct. 27, 2015, p. 1-p. 3.

* cited by examiner

100

COATING MODULE

CROSS-REFERENCE TO RELATED APPLICATION

This application claims the priority benefit of Taiwan application serial no. 101123480, filed on Jun. 29, 2012. The entirety of the above-mentioned patent application is hereby incorporated by reference herein and made a part of this specification.

BACKGROUND

1. Field of the Disclosure

The disclosure generally relates to a coating module, and more particularly, to a coating module able to change the plates thereof.

2. Description of Related Art

In recent years, in industrial processes, a coating device is often used to perform film-coating process, for example to form a raw strip on a ceramic capacitor or to coat optical protection film on a substrate. Taking a slot-type coating device as an example, the slot-type coating device is suitable for a film-coating process of large area. The coating device has a restrictor, and liquid is conveyed into the coating device by a measuring pump, and then outflows from a slot outlet of the coating device. The measuring pump can provide a stable supply of liquid. Therefore, the degree of uniformity for the coating liquid of the coating device will depend on the smoothness of the surface of the restrictor.

The coating device is generally formed by using two stainless steel modules to hold a shim. The shim has a restrictor and a diversion structure connecting the restrictor thereon, in which the diversion structure is, for example, a flow channel or a manifold so as to guide the liquid into the restrictor. The diversion structure mainly includes three types: T-die type structure, fishtail type structure and coat-hanger type structure. The processing and fabrication of the T-die type structure are more easily and able to make the flow rate of the liquid uniformly distributed, but the liquid is easy to form residue at the end of the manifold. The fishtail type structure enables the liquid to be uniformly spread in the flow channel, but the liquid is easy to form a recirculation zone in the diversion structures to affect the flow rate. The coat-hanger type structure can reduce the problems for the T-die type structure and the fishtail type structure to respectively produce the residue zone or the recirculation zone, but they are disadvantageous in complicate design and higher production cost. Therefore, the film-coating process usually employs a coating device with different diversion structure according to the coating liquid characteristic and the coating method, which makes a coating device very difficult to be shared for different film-coating processes.

On the other hand, in order to uniformly coating with a liquid by a coating device, the surface of the shim used to form the diversion structure and the restrictor, particularly the surface of the restrictor, must have high smoothness. Therefore, the shim requires lapping and polishing to increase the surface smoothness thereof. And, if the shim has a diversion structure with more complicate design, the shim needs for additional machining on each processing surface followed by lapping and polishing, so that the liquid can flow on the shim uniformly. These processes increase the manufacturing cost of the coating device. Further, when the restrictor of such a coating device gets worn, it is necessary to replace the shim to ensure the uniformity of the coating fluid. Thus, such a coating device has higher manufacturing costs, which accordingly indirectly increases the production cost of the products by using these coating devices for film-coating process.

SUMMARY OF THE DISCLOSURE

Accordingly, the disclosure is directed to a coating module with lower production cost and better reusability.

The disclosure provides a coating module suitable for coating a liquid onto a substrate and includes two plates and a diversion structure, in which there is a slot between the plates, an end of the slot has a slot inlet, the other end of the slot has a slot outlet, and one of the plates has an injecting port. The diversion structure makes the injecting port communicated with the slot inlet, in which the liquid is configured to enter the diversion structure via the injecting port, then flow to the slot inlet through the diversion structure, then flow into the slot via the slot inlet, and then outflow from the slot via the slot outlet to be coated onto the substrate.

In an embodiment of the disclosure, the material of the plates includes silicon wafer or glass.

In an embodiment of the disclosure, the diversion structure includes a diversion inlet, a diversion channel and a manifold. The diversion inlet is communicated with the injecting port, the diversion channel is communicated with the diversion inlet, and the manifold makes the diversion channel communicated with the slot inlet, and the liquid is configured to uniformly flow to the slot inlet via the manifold.

In an embodiment of the disclosure, the diversion structure has a diversion pattern, and the diversion pattern is located on the diversion channel for guiding the liquid flowing on the diversion channel.

In an embodiment of the disclosure, the diversion pattern includes a shunting island and the shunting island is located at the slot outlet.

In an embodiment of the disclosure, the coating module further includes two fixtures for fixing the plates between the fixtures, in which the injecting port is located on one of the fixtures, and the diversion structure is formed by a part of one of the fixtures and makes the injecting port communicated with the slot inlet.

In an embodiment of the disclosure, each of the fixtures has a positioning groove, and the plates are detachably disposed in the positioning grooves to form the slot.

In an embodiment of the disclosure, each of the fixtures has a plurality of apertures, a vacuum chamber and a vacuum channel, the apertures are located on the positioning grooves and communicated with the vacuum chamber, the vacuum chamber is communicated with the vacuum channel, and the vacuum channel is configured to be connected to a vacuum device and respectively adsorb the plates through the vacuum device into the positioning grooves so as to form the slot.

In an embodiment of the disclosure, each of the fixtures has an elastic member, and each the elastic member is located between the corresponding plate and the corresponding positioning groove for adjusting the width of the slot.

In an embodiment of the disclosure, the diversion structure is formed by a part of one of the plates or formed together by parts of the two plates and the diversion structure makes the injecting port communicated with the slot inlet.

In an embodiment of the disclosure, the plate with the diversion structure is a micromachining plate.

In an embodiment of the disclosure, the coating module further includes two fixtures, for fixing the plates between the fixtures, in which one of the fixtures has a fixing groove, and the plates are detachably fixed in the fixing groove.

In an embodiment of the disclosure, the coating module further includes a sealing cushion, located between one of the plates and the corresponding fixture.

In an embodiment of the disclosure, the material of one of the plates and the corresponding fixture is transparent material to observe the flow of the liquid in the diversion structure.

In an embodiment of the disclosure, the coating module further includes a vacuum chamber, located at one of the fixtures and communicated with the fixing groove, wherein the vacuum chamber is configured to be connected to a vacuum device to form a vacuum state at the slot outlet.

In an embodiment of the disclosure, two pairs of the plates are detachably fixed in the fixing groove, so that the liquid is adapted to outflow from the slots via the slot outlets to be coated onto the substrate.

Based on the description above, in the coating module provided by the disclosure, there is a slot between two plates, and the slot has a slot inlet and a slot outlet. Two fixtures fix the plates and have an injecting port. The diversion structure makes the injecting port communicated with the slot inlet. The liquid can flow into the slot via the injecting port, the diversion structure and the slot inlet, and then, outflow from the coating module via the slot outlet. In this way, the coating module can coat the liquid onto a substrate. When the plates of the coating module get worn, the plates can be removed away from the fixtures to replace the worn ones with new plates, and thus, the coating module has lower production cost and better reusability.

In order to make the features and advantages of the present disclosure more comprehensible, the present disclosure is further described in detail in the following with reference to the embodiments and the accompanying drawings.

DESCRIPTION OF THE EMBODIMENTS

Figure 1:
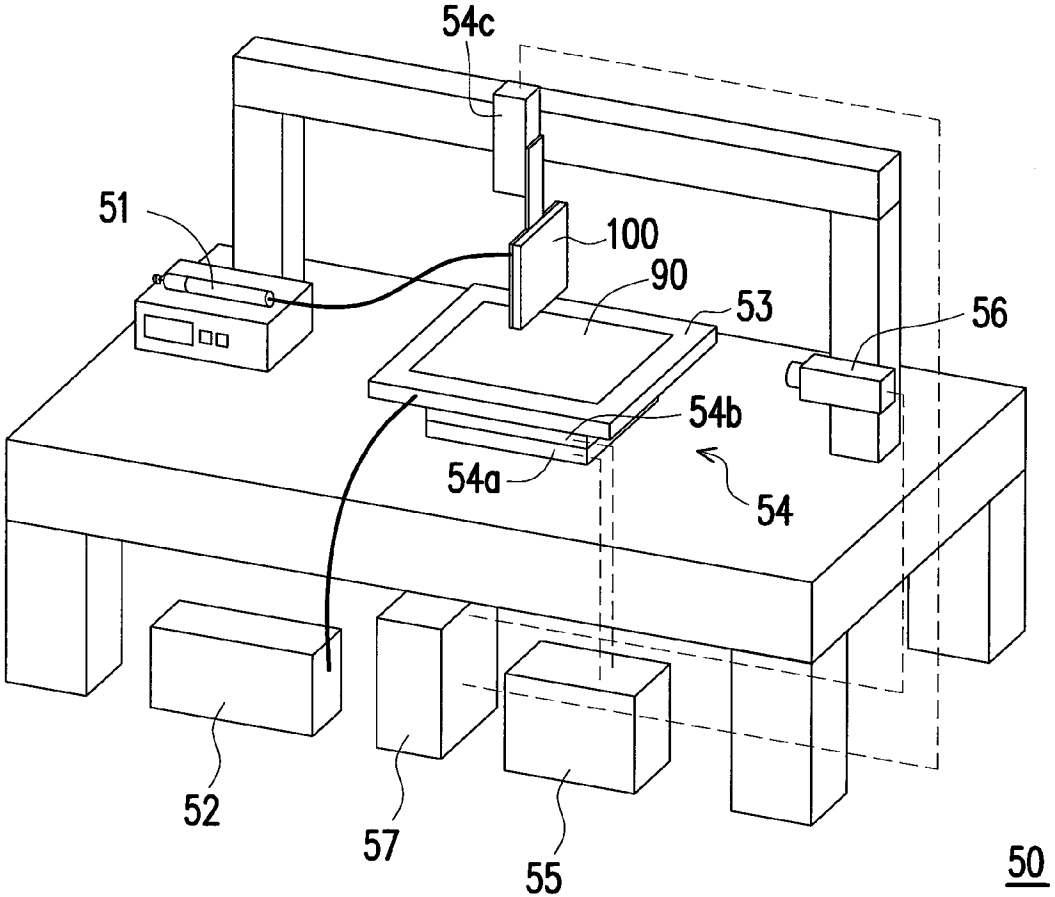
FIG. 1 is a schematic diagram of a coating module used in a coating system according to an embodiment of the disclosure.

FIG. 1 is a schematic diagram of a coating module used in a coating system according to an embodiment of the disclosure. Referring to FIG. 1, a coating module 100 is configured to connect to a coating system 50 so as to coat liquid (not shown) onto a substrate 90. In more details, the coating module 100 is connected to a liquid-supplying device 51 to make the liquid enter the coating module 100 from the liquid-supplying device 51. The substrate 90 is fixed on an adsorbing stage 53 by a vacuum device 52 and the adsorbing stage 53 is connected to a control system 54. The control system 54 provides three sliding stages 54*a*, 54*b* and 54*c* able to move respectively along three orthogonal axes to make the substrate 90 move relatively to the coating module 100.

The coating rate and coating position of the coating module 100 depends on the moving direction and speed of the adsorbing stage 53, therefore, the adsorbing stage 53 is connected to a stage controller 55 for controlling the displacement amount and displacement speed of the adsorbing stage 53. In addition, the coating system 50 further has an image-capturing system 56, and the image-capturing system 56 is connected to a computer 57 to instantly observe the interval between the coating module 100 and the substrate 90 for adjustment.

Figure 2:
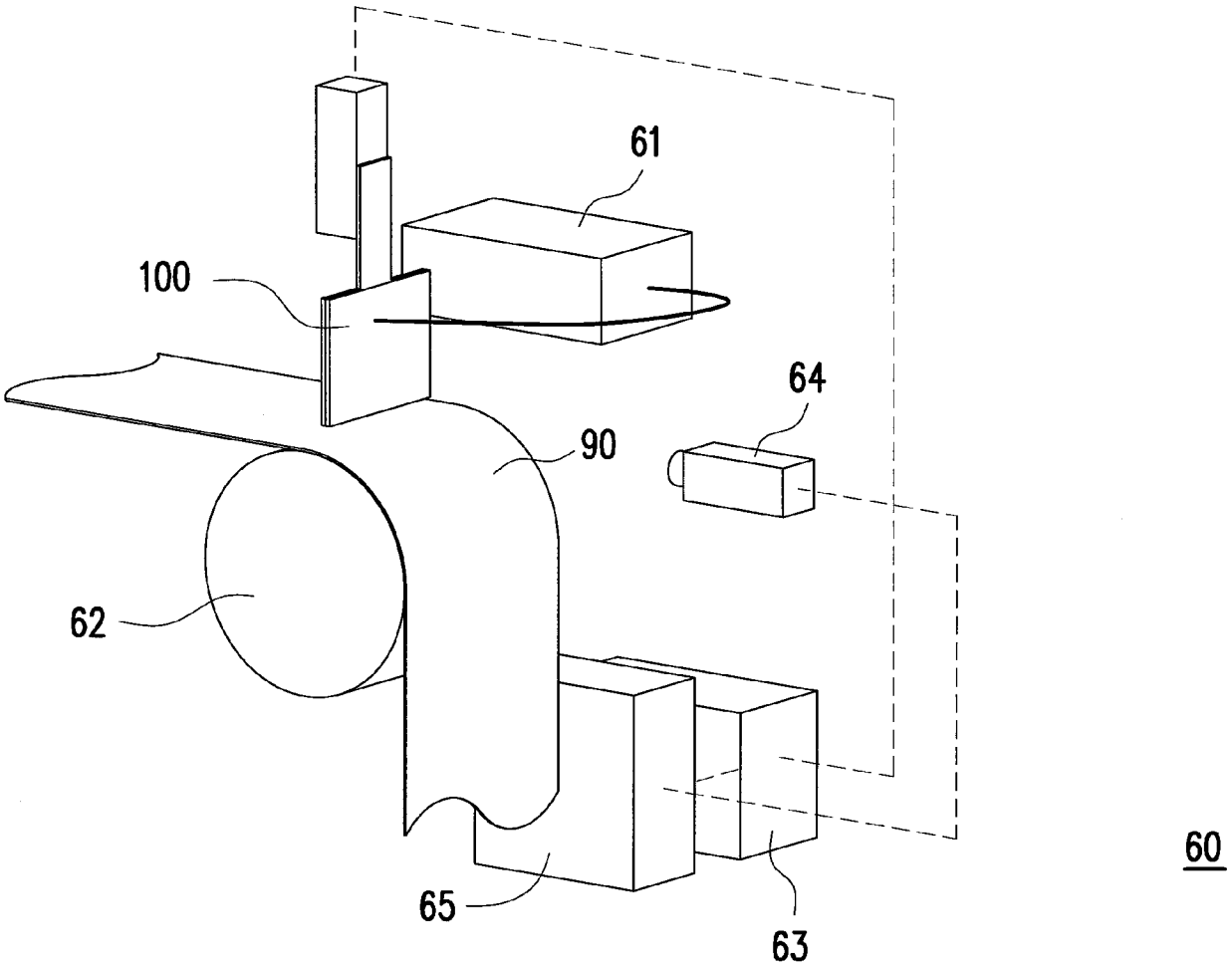
FIG. 2 is a schematic diagram of a coating module used in another coating system according to an embodiment of the disclosure.

FIG. 2 is a schematic diagram of a coating module used in another coating system according to an embodiment of the disclosure. Referring to FIG. 2, the coating module 100 is configured to connect a coating system 60 to coat the liquid onto the substrate 90. In more details, the coating module 100 is connected to a liquid-supplying device 61 to make the liquid enter the coating module 100 from the liquid-supplying device 61. The substrate 90 can move relatively to the coating module 100 through a roller system 62.

The coating rate and coating position of the coating module 100 depends on the moving direction and speed of the roller system 62. Therefore, the roller system 62 is connected to a roller controller 63 to control the displacement amount and displacement speed of the roller system 62. In addition, the coating system 60 further has an image-capturing system 64, and the image-capturing system 64 is connected to a computer 65 to instantly observe the interval between the coating module 100 and the substrate 90 for adjustment.

Figure 3A:
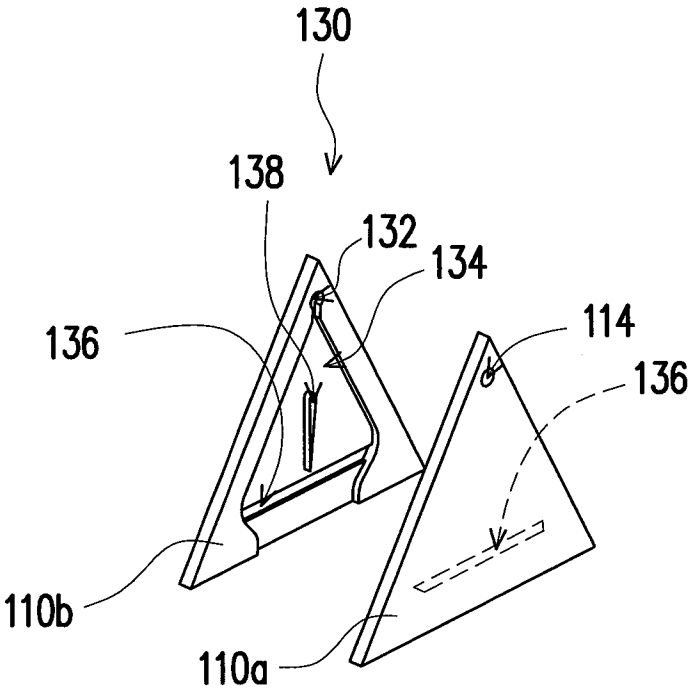
FIG. 3A is an exploded diagram of a coating module according to an embodiment of the disclosure.
Figure 3B:
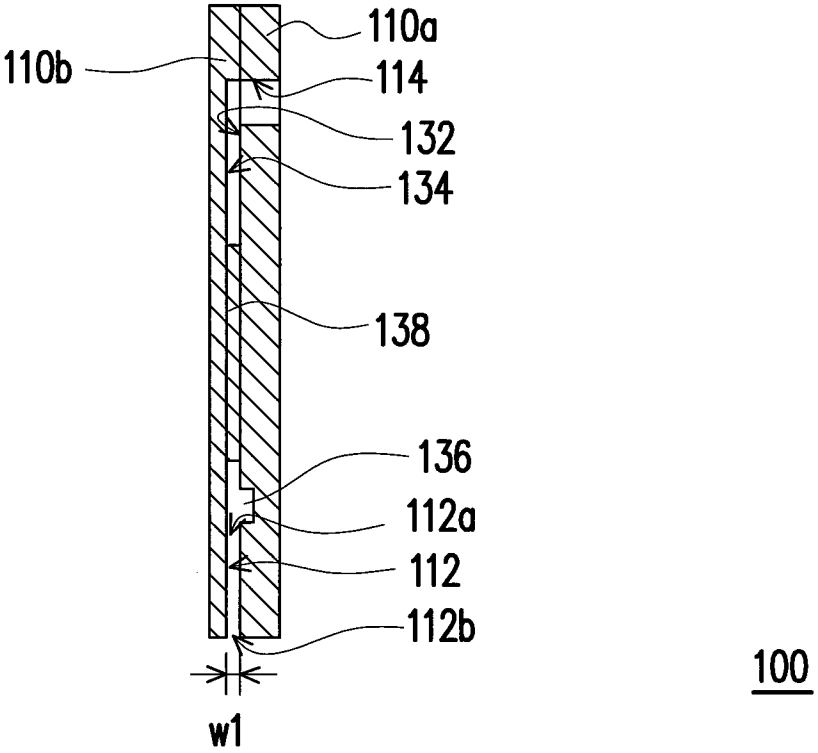
FIG. 3B is a cross-sectional diagram of the coating module of FIG. 3A after assembling.

FIG. 3A is an exploded diagram of a coating module according to an embodiment of the disclosure and FIG. 3B is a cross-sectional diagram of the coating module of FIG. 3A after assembling. Referring to FIGS. 3A and 3B, in the embodiment, the coating module 100 includes two plates 110*a* and 110*b* and a diversion structure 130. In more details, the plates 110*a* and 110*b* are disposed oppositely to each other, and there is a slot 112 between the plate 110*a* and the plate 110*b* (as shown by FIG. 3B). An end of the slot 112 has a slot inlet 112*a* and the other end of the slot 112 has a slot outlet 112*b*.

Referring to FIGS. 3A and 3B again, in the embodiment, the plate 110*a* has an injecting port 114, and the injecting port 114 goes through the plate 110*a* to make the interior and the exterior of the coating module 100 communicated with each other. Thus, the liquid can be injected into the coating module 100 via the injecting port 114 and then flow out of the coating module 100 from the slot outlet 112*b* through the slot 112.

On the other hand, the diversion structure 130 is located between the injecting port 114 and the slot 112. In the embodiment, the diversion structure 130 is formed together by a part of the plate 110*a* and a part of the plate 110*b* and makes the injecting port 114 communicated with the slot inlet 112*a*. In other words, the diversion structure 130 is located on the plate 110*a* and the plate 110*b*, and the slot 112 is located at the tail ends of the plates 110*a* and 110*b* and communicated with the diversion structure 130. Therefore, after the liquid enters the diversion structure 130 from the injecting port 114, the liquid flows to the slot inlet 112*a* via the diversion structure 130 on the plates 110*a* and 110*b*, then flows into the slot 112 via the slot inlet 112*a*, and then outflows from the coating module 100 via the slot outlet 112*b*.

In more details, the diversion structure 130 includes a diversion inlet 132, a diversion channel 134 and a manifold 136. The diversion inlet 132 is communicated with the injecting port 114. The diversion channel 134 is communicated with the diversion inlet 132 and the manifold 136 makes the diversion channel 134 communicated with the slot inlet 112*a*. In the embodiment, most part of the diversion structure 130 is located on the plate 110*b*. The diversion structure 130 can be seen as a groove structure on the plane of the plate 110*b*. As a result, when the two plates 110*a* and 110*b* are fixed by each other, for example, through anode bonding, the plate 110*a* leans against the plate 110*b*. At the time, the groove structure of the diversion structure 130 forms a space between the two plates 110*a* and 110*b* tight to each other, as shown by FIG. 3B, which makes the liquid flow in the diversion structure 130.

In the same way, the slot 112 located at the tail ends of the plates 110*a* and 110*b* and communicated with the diversion structure 130 can be also seen as a groove structure on the plate 110*b* and communicated with a part of the diversion structure 130 on the plate 110*b*. As a result, when the two plates 110*a* and 110*b* lean against each other, the tail ends between the plates 110*a* and 110*b* form the slot 112 through the groove structure. By adjusting the depth of the groove on the plate 110*b*, the coating module 100 can control the slot width w1 of the slot 112.

Figure 4A:
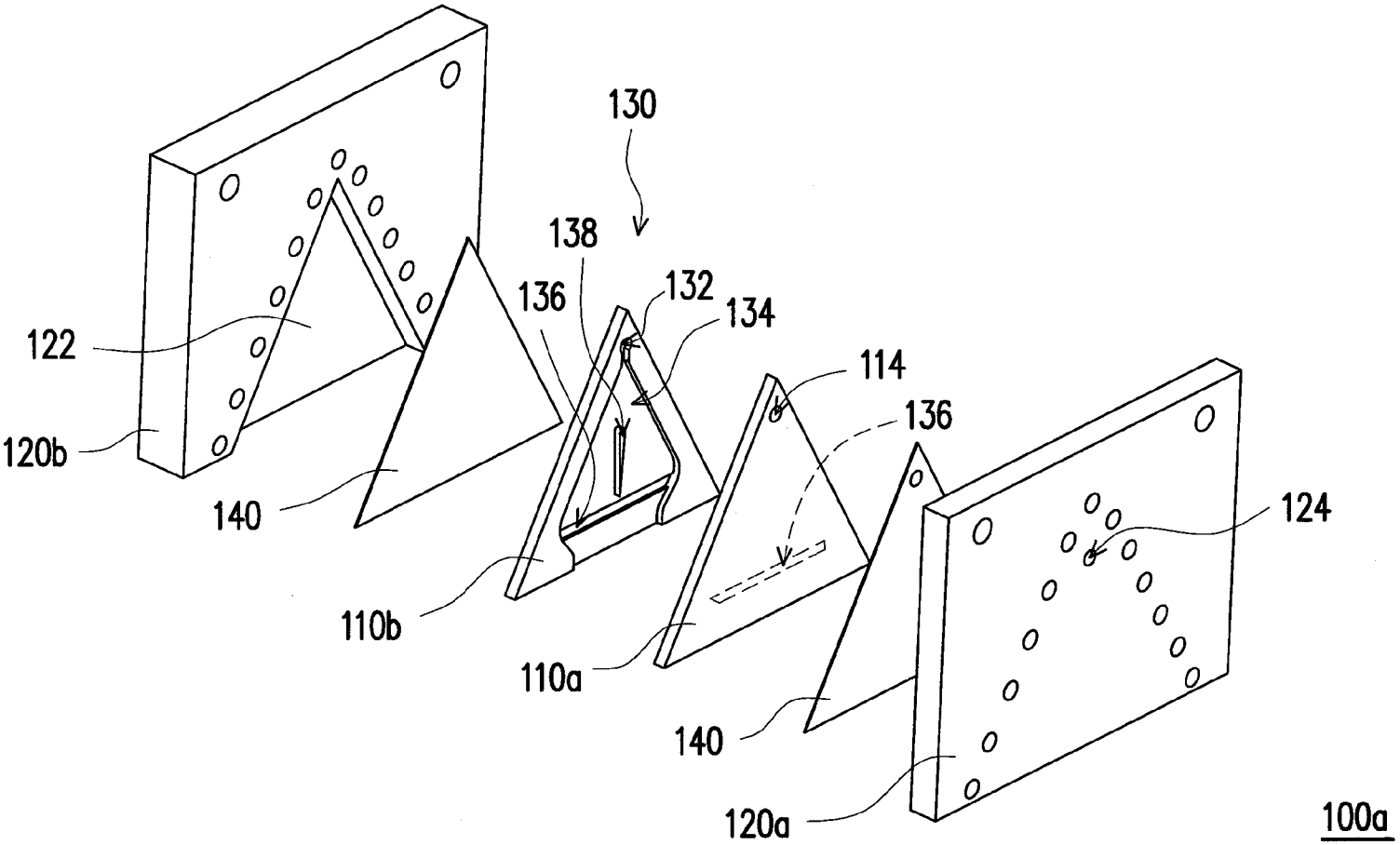
FIG. 4A is an exploded diagram of a coating module according to another embodiment of the disclosure.
Figure 4B:
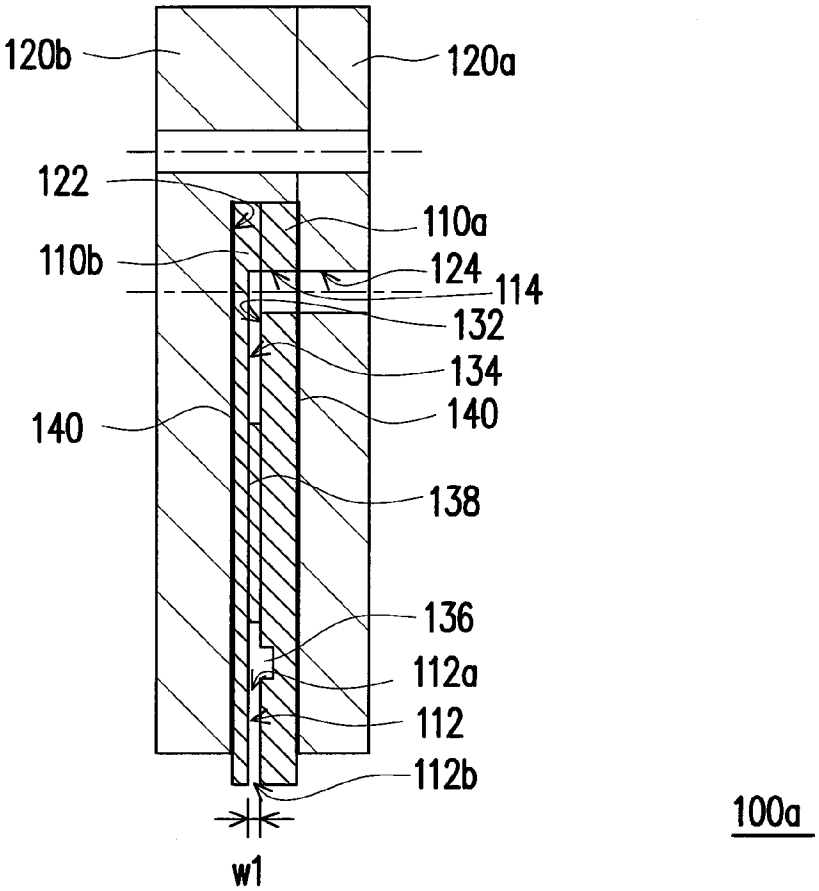
FIG. 4B is a cross-sectional diagram of the coating module FIG. 4A after assembling.

FIG. 4A is an exploded diagram of a coating module according to another embodiment of the disclosure and FIG. 4B is a cross-sectional diagram of the coating module FIG. 4A after assembling. Referring to FIGS. 4A and 4B, in the embodiment, the major difference of the coating module 100*a* from the coating module 100 rests in that the coating module 100*a* includes two fixtures 120*a* and 120*b*, and the fixtures 120*a* and 120*b* are disposed oppositely to each other and fix the plates 110*a* and 110*b* between the fixtures 120*a* and 120*b*, so that they are fixed by each other through a plurality of fasteners (for example, screws). In this way, the bonding between the plates 110*a* and 110*b* is more stable.

Referring to FIGS. 4A and 4B again, in the embodiment, the fixture 120*b* has a fixing groove 122, and the plates 110*a* and 110*b* can be detachably fixed in the fixing groove 122. Thus, the fixing groove 122 can provide the positioning function for the plates 110*a* and 110*b* in association with fixing the plates 110*a* and 110*b* by the fixtures 120*a* and 120*b*. The fixture 120*a* has an injecting port 124, the injecting port 124 goes through the fixture 120*a* and is corresponding to the injecting port 114 so as to make the interior and the exterior of the coating module 100*a* communicated with each other. As a result, the liquid can be injected into the coating module 100*a* via the injecting port 114, and then flow out of the coating module 100*a* from the slot outlet 112*b* through the slot 112.

Figure 5:
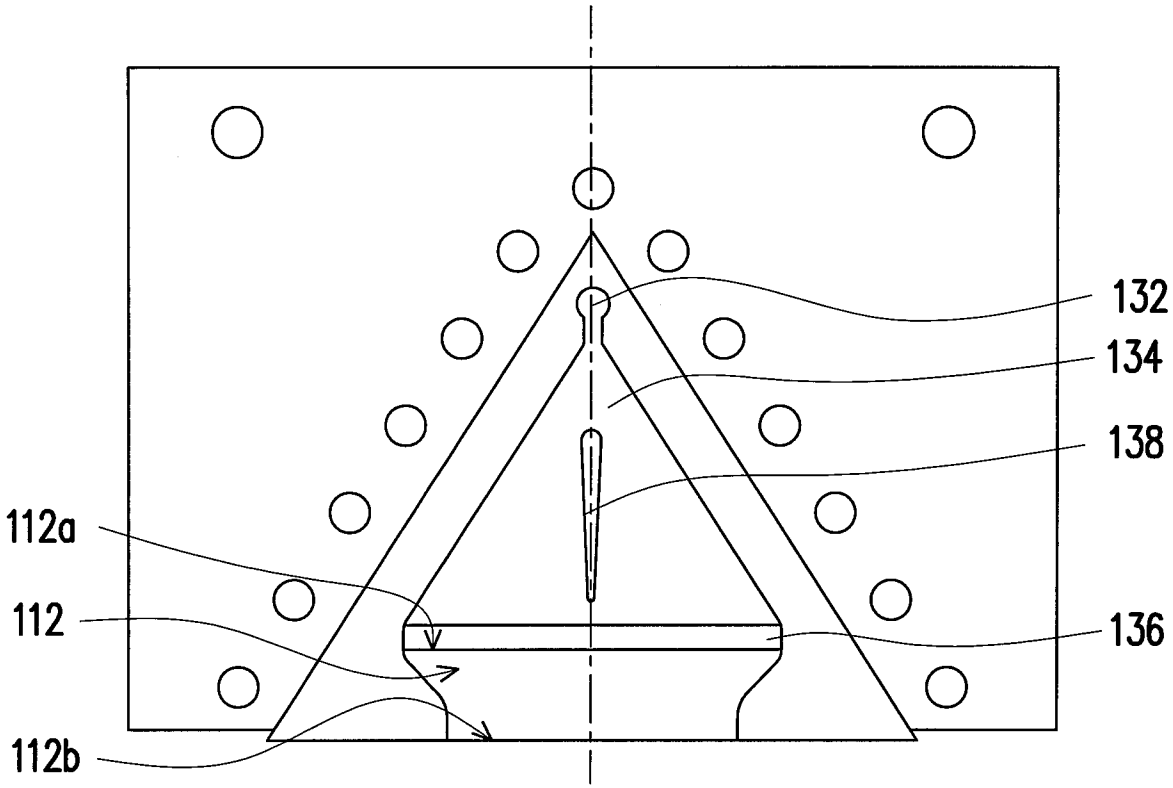
FIG. 5 is a front-view diagram of the coating module of FIG. 4A.

FIG. 5 is a front-view diagram of the coating module of FIG. 4A. It should be noted that the following depiction about the plates 110*a* and 110*b* and the diversion structure 130 is, for example, based on the coating module 100*a*. Since the major difference between the coating module 100*a* and the coating module 100 rests in whether employing the fixtures 120*a* and 120*b*, therefore, the following depiction about the plates 110*a* and 110*b* and the diversion structure 130 is suitable for the coating module 100 as well.

Referring to FIGS. 4A and 5, in the embodiment, the diversion inlet 132 and the injecting port 114 are corresponding to the injecting port 124 located on the fixture 120*a*, while the slot 112 is a slim slot formed by the plane-type plates 110*a* and 110*b*. Thus, the diversion channel 134 and the manifold 136 between the diversion inlet 132 and the slot 112 need to uniformly disperse the liquid flowing into the diversion structure 130 from the hole-pass to a slim current, so that the liquid flowing into the diversion structure 130 can uniformly flow in the slot 112.

In the embodiment, the diversion inlet 132 is connected to the diversion channel 134 roughly in fishtail shape to make the liquid flowing into the diversion structure 130 flow dispersedly. The manifold 136 is a groove in long bar shape corresponding to the shape of the slot inlet 112*a* and is located on the plate 110*b*. After the liquid flows from the diversion channel 134, the manifold 136 can expand the liquid current to make the liquid dispersedly flow, and thus, the dispersed liquid current uniformly flows to the slim slot inlet 112*a* via the manifold 136.

In comparison with the diversion inlet 132 and the diversion channel 134, the depth of the manifold 136 is greater than the depths of the diversion inlet 132 and the diversion channel 134. In the embodiment, the manifold 136 is also disposed at the position on the plate 110*a* corresponding to the manifold 136 of the plate 110*b*. In other words, the manifold 136 is formed by two long-bar grooves on the plates 110*a* and 110*b* for increasing the depth of the manifold 136. As a result, by disposing the manifold 136 with a larger depth on the plates 110*a* and 110*b*, the liquid flowing into the manifold 136 from the diversion channel 134 gets dispersed.

In other embodiments of the disclosure however, the manifold 136 can be disposed on one of the plates 110*a* and 110*b*. In other unshown embodiments of the disclosure, the whole diversion structure 130 can be located on one of the plates 110*a* and 110*b*, for example, on the plate 110*a* only, while the diversion inlet 132 goes through the plate 110*a* and is directly communicated with the injecting port 124. At the time, the plate 110*b* has no any groove thereon and it is a naked plate only. In other embodiments of the disclosure, the position of the diversion structure in the coating module is selected depending on the requirement, and the disclosure is not limited to.

Besides, in the embodiment, the diversion structure 130 has a diversion pattern 138, which is located at the diversion channel 134, and the diversion pattern 138 is a bar-shaped pillar located at the diversion channel 134 and protruded from the diversion channel 134 for guiding the liquid flowing on the diversion channel 134. The disclosure does not limit the shape and the disposing or not of the diversion pattern. In the coating module, the shape of the diversion pattern can be adjusted so as to modify the flowing of the liquid on the diversion channel 134 depending on the requirement, and it allows employing no diversion pattern at all.

In the embodiment, the plate 110*a* and the corresponding fixture 120*a* are made of transparent material. Thus, when the plates 110*a* and 110*b* are fixed between the fixtures 120*a* and 120*b* and the liquid flows into the diversion structure 130, the flowing situation of the liquid in the diversion structure 130 can be observed from the exterior of the coating module 100*a*, which the disclosure is not limited to.

Referring to FIG. 4A, in the embodiment, the coating module 100*a* has two sealing cushions 140 respectively located between the plate 110*a* and the fixture 120*a* and between the plate 110*b* and the fixture 120*b* to avoid the liquid leaked from the space between the plate 110*a* and the fixture 120*a* or the space between the plate 110*b* and the fixture 120*b*. In other embodiments of the disclosure, it allows no sealing cushions 140 to be disposed in the coating module 100*a* or only one sealing cushion 140 is employed and disposed between the plate 110*a* and the fixture 120*a* or between the plate 110*b* and the fixture 120*b*, which the disclosure is not limited to.

In the embodiment, the materials of the plates 110*a* and 110*b* are silicon wafer, while in other embodiments of the disclosure, the material of the plates is glass or other materials with surface roughness of nano-grade, which the disclosure is not limited to. A higher surface smoothness of the material of the plates 110*a* and 110*b* enables the liquid uniformly flowing in the slot 112 without the disturbance by the rough surface of the slot 112. As a result, after the liquid flows through the manifold 136 and uniformly flows into the slot 112 from around the slot inlet 112*a*, the liquid uniformly flows in the slot 112 and then uniformly outflows via around the slot outlet 112*b*.

In addition, since the diversion structure 130 of the embodiment is located on the plates 110*a* and 110*b*, so that the plates 110*a* and 110*b* can be formed on the plates 110*a* and 110*b* made of silicon wafer by using a micromachining process (such as lithography and etching processes). In more details, taking the plate 110*b* as example, first, a photoresist film is formed on the plate 110*b*. Next, the required pattern of the diversion structure 130 is disposed on a mask, then the mask is used to perform exposing on the photoresist film on the plate 110*b*, and finally, to perform developing on the photoresist film after exposure for patterning the photoresist film.

On the other hand, the patterned photoresist film is used as an etching mask to etch the plate 110*b* so as to form a part of the diversion structure 130 on the plate 110*b*. In the end, the patterned photoresist film is removed. In the same way, the rest part of the diversion structure 130 is formed on the plate 110*a* by using the same micromachining process (such as lithography and etching processes), which the disclosure is not limited to.

According to the depiction above, the coating module 100 and the coating module 100*a* can have different diversion structure 130 on the plates 110*a* and 110*b* depending on the requirement, for example, a diversion structure 130 in T-die type or in coat-hanger type, or the pattern or the arrangement of the diversion pattern 138 are modified. In order to coat different liquid by the coating module 100 and the coating module 100*a* or to obtain different coating effects, the coating module 100 and the coating module 100*a* are required to change the plates 110*a* and 110*b* having different diversion structures 130 only. In short, the coating module 100 and the coating module 100*a* have higher adaptation.

Figure 6:
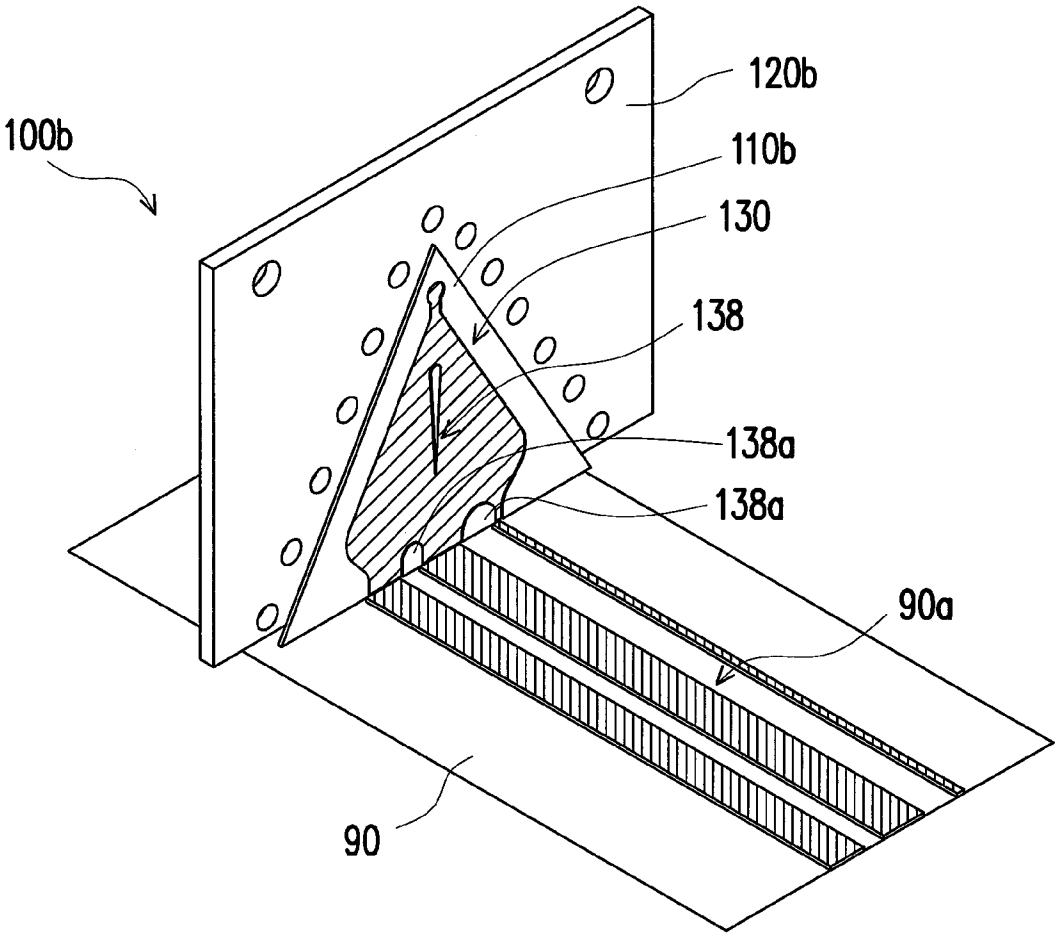
FIG. 6 is a schematic diagram of a coating module according to yet another embodiment of the disclosure.

FIG. 6 is a schematic diagram of a coating module according to yet another embodiment of the disclosure. In FIG. 6, only the fixture 120*b* and the plate 110*b* of the coating module 100*b* are shown to make the figure clearer. Referring to FIG. 6, the major difference of the coating module 100*b* in the embodiment from the coating module 100*a* rests in that the diversion pattern 138 of the coating module 100*b* has two shunting islands 138*a*. The shunting islands 138*a* are located at the slot outlet 112*b*. When the liquid outflows from the coating module 100*b* via the slot outlet 112*b* for coating on the substrate 90, the shunting islands 138*a* enable the liquid forming a stripe-like film 90*a*, i.e., a plurality of coating stripes. Therefore, by disposing shunting islands 138*a* with different quantity at the slot outlet 112*b* or adjusting the positions of the shunting islands 138*a*, the coating module 100*b* is able to coat a stripe-like film with different stripe quantity and different stripe interval.

When the substrate 90 requires to be coated with liquid having different properties thereon, or to obtain different coating effects, for example, to form the stripe-like film, the coating module 100 is required to change the plates 110*a* and 110*b* having different diversion structures 130 only. In addition, when the plates 110*a* and 110*b* with higher surface smoothness get damage due to the flowing of the liquid molecules, the plates 110*a* and 110*b* can be removed away from the fixing groove 122 and they are replaced by new plates 110*a* and 110*b*. At the time, to handle the surface wearing problem of the slot 112 in the coating module 100, only the plates 110*a* and 110*b* need to be replaced without replacing the whole coating module 100, which makes the coating module 100 have lower production cost and better reusability.

Figure 7:
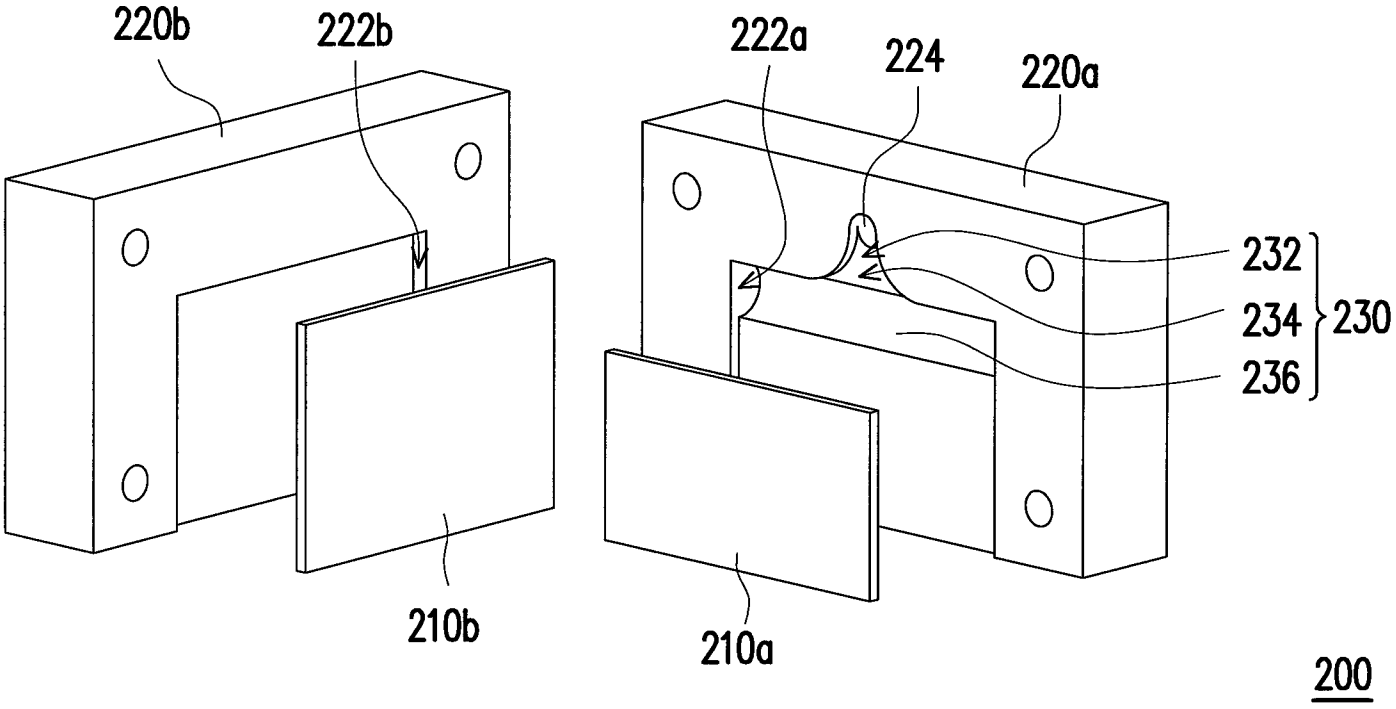
FIG. 7 is an exploded diagram of a coating module according to yet another embodiment of the disclosure.
Figure 8:
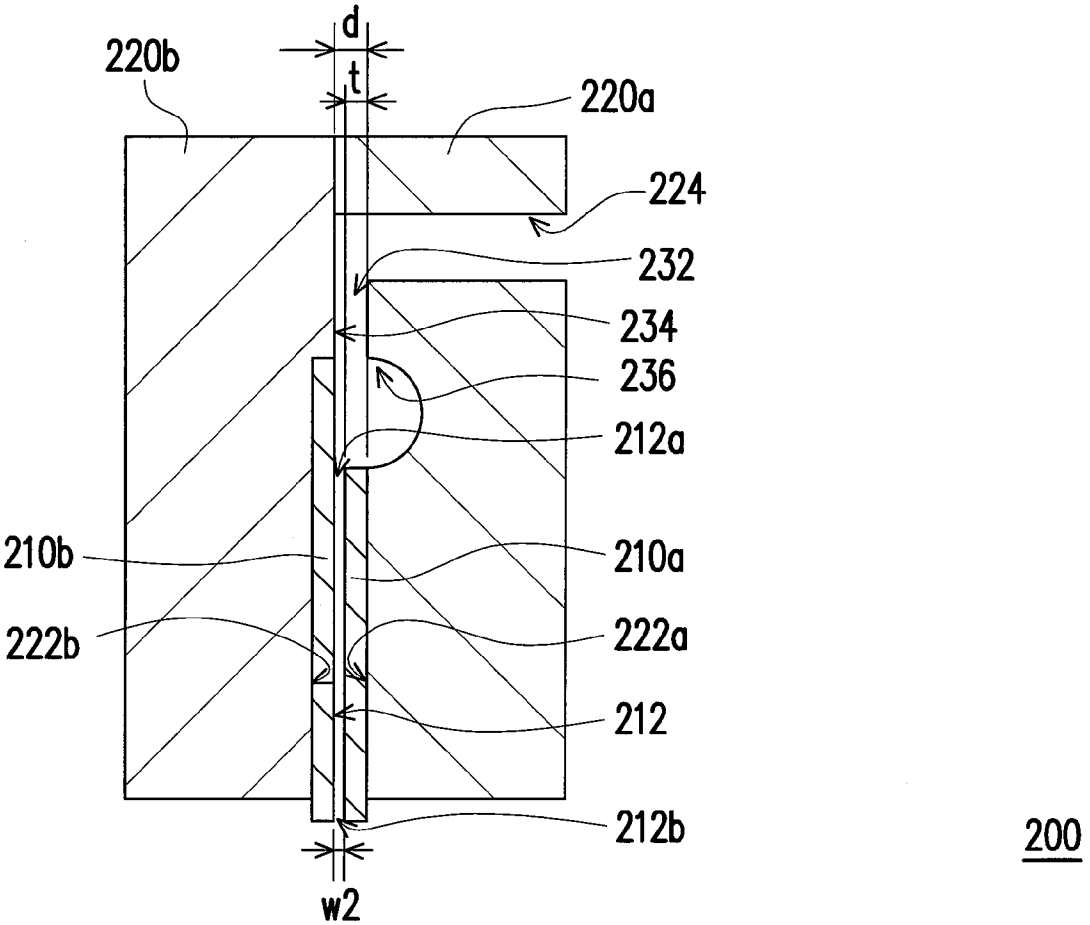
FIG. 8 is a cross-sectional diagram of the coating module of FIG. 7 after assembling.

FIG. 7 is an exploded diagram of a coating module according to yet another embodiment of the disclosure and FIG. 8 is a cross-sectional diagram of the coating module of FIG. 7 after assembling. Referring to FIGS. 7 and 8, in the embodiment, a coating module 200 includes two plates 210*a* and 210*b*, two fixtures 220*a* and 220*b* and a diversion structure 230. The plates 210*a* and 210*b* are disposed oppositely to each other and there is a slot 212 between the plate 210*a* and the plate 210*b* (as shown by FIG. 8). An end of the slot 212 has a slot inlet 212*a* and the other end of the slot 212 has a slot outlet 212*b*.

The fixtures 220*a* and 220*b* are disposed oppositely to each other and fix the plates 210*a* and 210*b* between the fixtures 220*a* and 220*b*, in which the fixtures 220*a* and 220*b* have a plurality of fastening holes (for example, thread holes) thereon, so that the fixtures 220*a* and 220*b* are fastened by each other through a plurality of fasteners (for example, screws).

In the embodiment, the fixtures 220*a* and 220*b* respectively have a positioning groove 222*a* and a positioning groove 222*b*, and the plates 210*a* and 210*b* are respectively detachably disposed in the positioning grooves 222*a* and 222*b* correspondingly. In more details, the plate 210*a* is detachably disposed in the positioning groove 222*a*, the plate 210*b* is detachably disposed in the positioning groove 222*b*, and the plates 210*a* and 210*b* keep opposite to each other. Thus, when the fixtures 220*a* and 220*b* fix the plates 210*a* and 210*b*, the positioning grooves 222*a* and 222*b* can make the plates 210*a* and 210*b* positioned.

Referring to FIG. 8, in the embodiment, the positioning groove 222*a* has groove depth d, the plate 210*a* has plate thickness t and the groove depth d of the positioning groove 222*a* is greater than the plate thickness t of the plate 210*a*. In addition, in the embodiment, the surface of the plate 210*b* is flush with the surface of the fixture 220*b* outside the positioning groove 222*b*, which the disclosure is not limited to. So, when the plates 210*a* and 210*b* are respectively disposed at the corresponding positioning grooves 222*a* and 222*b*, the plate 210*a* is entirely located in the positioning groove 222*a* and the plate 210*b* is entirely located in the positioning groove 222*b*. When the two fixtures 220*a* and 220*b* are fixed by each other, the fixture 220*a* leans against the fixture 220*b*, but the plate 210*a* does not lean against the plate 210*b*. In this way, the slot 212 is formed between the plate 210*a* and the plate 210*b* through the dimension difference between the groove depth d and the plate thickness t.

On the other hand, the slot 212 has slot width w2. When the plates 210*a* and 210*b* are respectively disposed in the corresponding positioning grooves 222*a* and 222*b* to form the slot 212 between the plates 210*a* and 210*b*, the slot width w2 depends on the dimension difference between the groove depth d and the plate thickness t. In this way, the slot width w2 of the slot 212 in the coating module 200 can be controlled by adjusting the dimension difference between the groove depth d and the plate thickness t.

Referring to FIGS. 7 and 8, in the embodiment, the fixture 220*a* has an injecting port 224, and the injecting port 224 goes through the fixture 220*a* and is communicated with the interior and exterior of the coating module 200. Thus, the liquid can be injected into the coating module 200 via the injecting port 224 and then flow out of the coating module 200 from the slot outlet 212*b* through the slot 212.

On the other hand, the diversion structure 230 is located between the injecting port 224 and the slot 212. In the embodiment, the diversion structure 230 is formed by a part of the fixture 220*a* and makes the injecting port 224 communicated with the slot inlet 212*a*. After the liquid enters the diversion structure 230 from the injecting port 224, the liquid flows to the slot inlet 212*a* via the diversion structure 230 on the fixture 220*a*, then flows into the slot 212 via the slot inlet 212*a*, and then outflows from the coating module 200 via the slot outlet 212*b*.

In more details, the diversion structure 230 includes a diversion inlet 232, a diversion channel 234 and a manifold 236. The diversion inlet 232 is communicated with the injecting port 224. The diversion channel 234 is communicated with the diversion inlet 232. The manifold 236 makes the diversion channel 234 communicated with the slot inlet 212*a*. In the embodiment, the diversion structure 230 is located on the fixture 220*a* and makes the injecting port 224 communicated with the slot inlet 212*a* through being communicated with the positioning groove 222*a* located on the same fixture 220*a*. In other words, the diversion structure 230 is a groove structure located on the plane of the fixture 220*a*. When the fixture 220*a* leans against the fixture 220*b*, the groove structure of the diversion structure 230 forms a space between the fixture 220*a* and the fixture 220*b* tight to each other, so that the liquid is able to flow in the diversion structure 230.

Referring to FIG. 7 again, in the embodiment, the diversion inlet 232 is an open hole located on the fixture 220*a* and corresponding to the injecting port 224, while the slot 212 is a slim slot formed by the plane-type plates 210*a* and 210*b*. As a result, the diversion channel 234 and manifold 236 located between the diversion inlet 232 and the slot 212 need to uniformly disperse the liquid entering the diversion structure 230 from the hole-pass to a slim current, so that the liquid entering the slot 212 can uniformly flow in the slot 212.

In more details, in the embodiment, the diversion inlet 232 is connected to the diversion channel 234 roughly in fishtail shape so that the liquid entering the diversion inlet 232 can dispersedly flow. The manifold 236 is a groove with a long-bar shape corresponding to the shape of the slot inlet 212*a* and is located in the positioning groove 222*a*. The length of the plate 210*a*, thus, is less than the length of the plate 210*b*. The plate 210*a* links up the bottom of the manifold 236 (as shown by FIG. 7) to make the manifold 236 communicated with the slot inlet 212*a*. After the liquid outflows from the diversion channel 234, the manifold 236 makes the liquid expanded and dispersed so that the dispersedly flowing liquid uniformly flow to the slim slot inlet 212*a* via the manifold 236.

In comparison with the diversion inlet 232 and the diversion channel 234, the depth of the manifold 236 is greater than the depths of the diversion inlet 232 and the diversion channel 234. In short, by disposing the manifold 236 with larger depth on the fixture 220*a*, the liquid flowing into the manifold 236 from the diversion channel 234 becomes dispersed.

In the embodiment, the materials of the plates 210*a* and 210*b* are silicon wafer, while in other embodiments of the disclosure, the material of the plates is glass or other materials with surface roughness of nano-grade, which the disclosure is not limited to. A higher surface smoothness of the material of the plates 210*a* and 210*b* enables the liquid flowing in the slot 212 without the disturbance by the rough surface of the slot 212. As a result, after the liquid flows through the manifold 236 and uniformly flows into the slot 212 from around the slot inlet 212*a*, the liquid uniformly flows in the slot 212 and then uniformly outflows via around the slot outlet 212*b*.

In the embodiment, the plates 210*a* and 210*b* are adhered into the corresponding positioning groove 222*a* and positioning groove 222*b* through adhesive or other adhering ways. Thus, the plates 210*a* and 210*b* are fixed in the positioning groove 222*a* and the positioning groove 222*b* in adhering way. In order to remove out the plates 210*a* and 210*b* from the positioning groove 222*a* and the positioning groove 222*b*, an appropriate solvent is used. It should be noted that the adhesive for adhering the plates 210*a* and 210*b* should not react with the liquid flowing in the coating module 200 to avoid the adhesive from failure to make the plates 210*a* and 210*b* separated after the liquid flows into the coating module 200.

Figure 9:
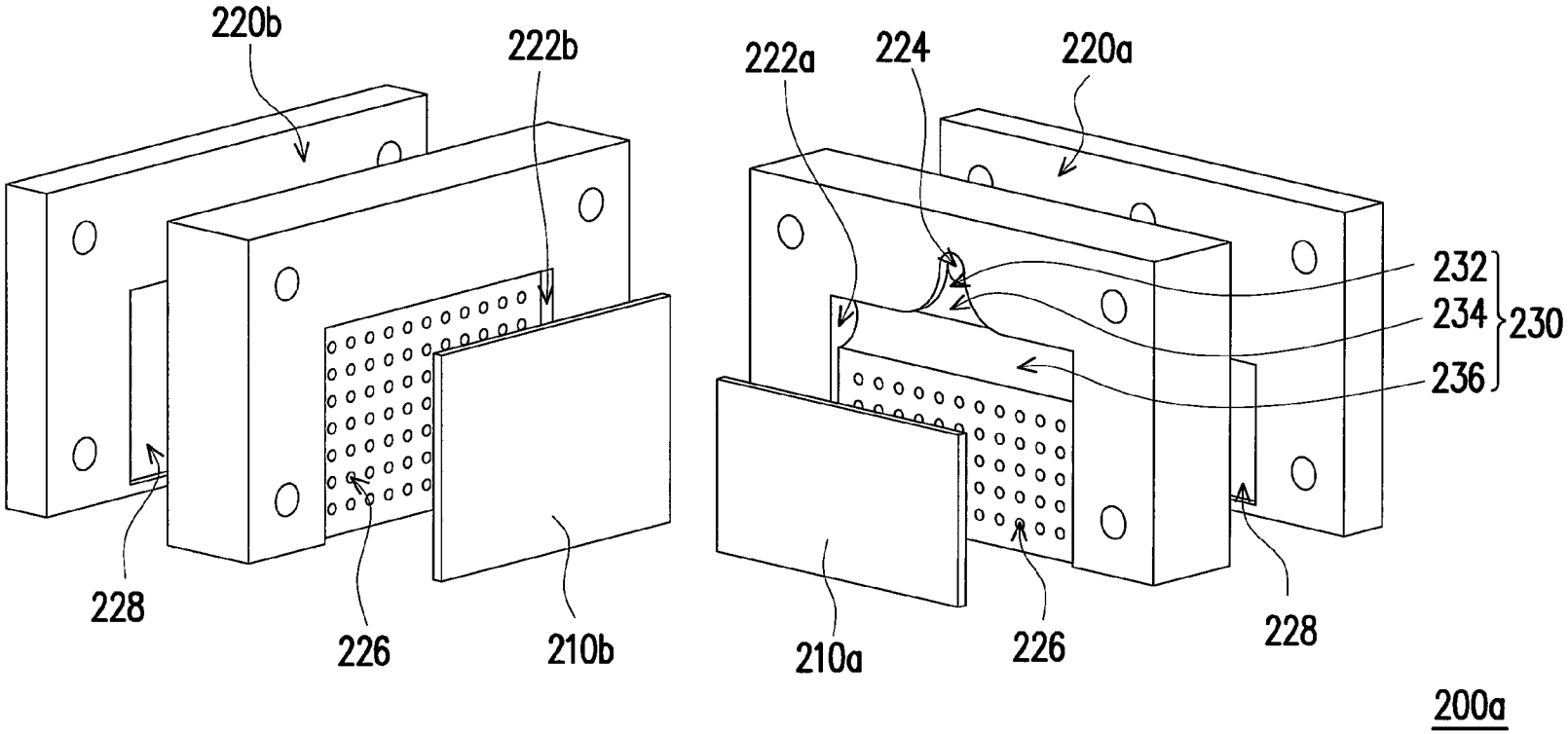
FIG. 9 is an exploded diagram of a coating module according to yet another embodiment of the disclosure.
Figure 10:
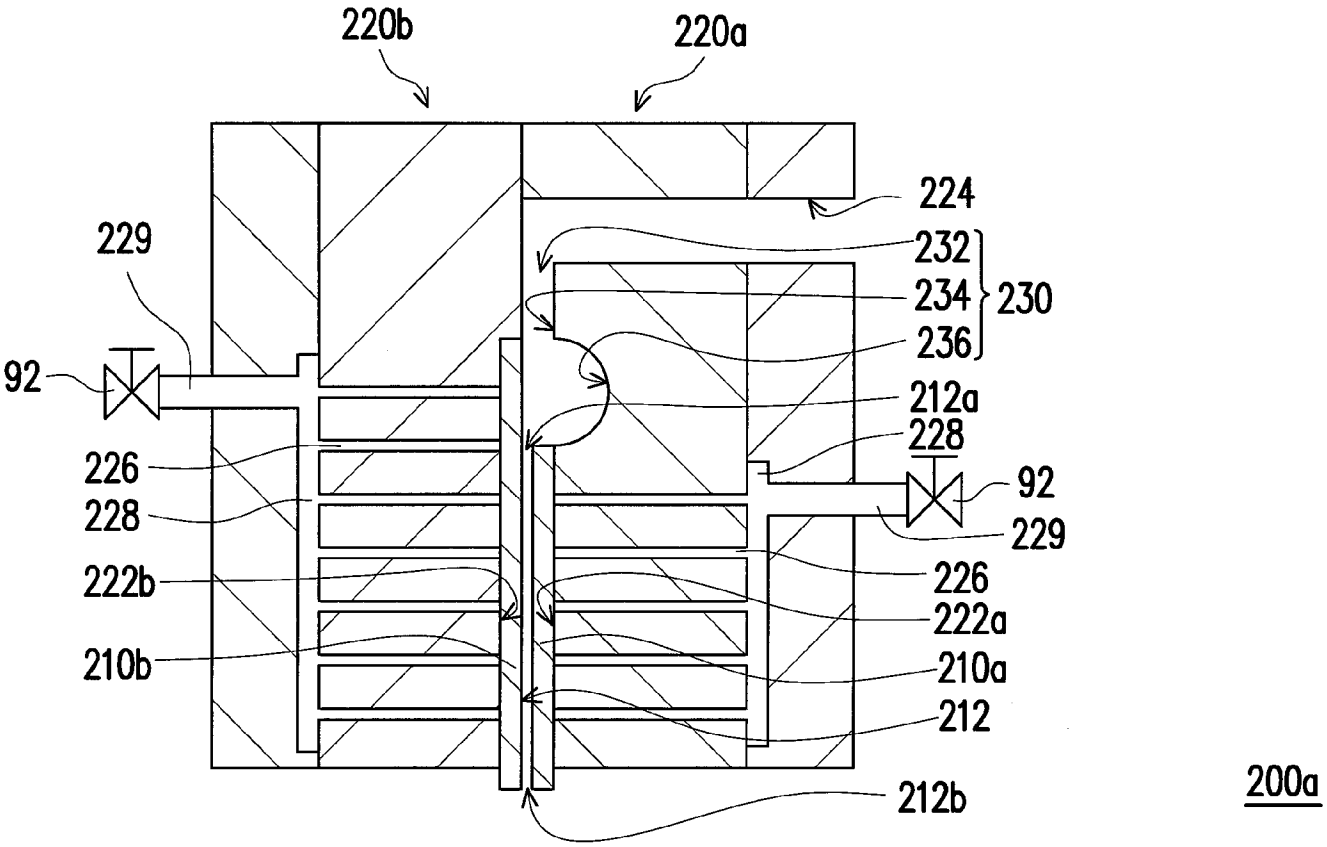
FIG. 10 is a cross-sectional diagram of the coating module of FIG. 9 after assembling.

FIG. 9 is an exploded diagram of a coating module according to yet another embodiment of the disclosure and FIG. 10 is a cross-sectional diagram of the coating module of FIG. 9 after assembling. In yet another embodiment of the disclosure, the plates 210*a* and 210*b* in the coating module 200*a* are adsorbed to the positioning groove 222*a* and the positioning groove 222*b* by a vacuum device 92, so that the plates 210*a* and 210*b* are fixed and disposed in the corresponding positioning groove 222*a* and positioning groove 222*b*.

In more details, the fixtures 220*a* and 220*b* of the coating module 200*a* respectively have a plurality of apertures 226, a vacuum chamber 228 and a vacuum channel 229. Taking the fixture 220*a* as an example, the apertures 226 are located on the positioning groove 222*a* and communicated with the vacuum chamber 228. The vacuum chamber 228 is communicated with the vacuum channel 229. The vacuum channel 229 is communicated with the exterior of the fixture 220*a* and connected to the vacuum device 92. In the same way, the fixture 220*b* is communicated with the exterior of the fixture 220*b* and connected to the vacuum device 92 via the apertures 226, the vacuum chamber 228 and the vacuum channel 229.

In order to simplify the fabrications of the apertures 226, the vacuum chamber 228 and the vacuum channel 229, in the embodiment, each of the fixtures 220*a* and 220*b* can be divided into two portions for individual fabrication. For the fixture 220*a* as an example, the fixture 220*a* is divided into two fixing modules. The positioning groove 222*a* is located on the fixing module close to the plate 210*a* and at a side of the fixing module facing the plate 210*a*, and the apertures 226 go through the fixing module until the other side of the fixing module from the positioning groove 222*a*. The vacuum chamber 228 and the vacuum channel 229 are located on the other fixing module far away from the plate 210*a*, and the vacuum chamber 228 and the vacuum channel 229 are together make the opposite two sides of the fixing module communicated with each other (as shown by FIG. 9). Thus, when the two fixing modules are joined to form the fixture 220*a*, the apertures 226, the vacuum chamber 228 and the vacuum channel 229 are communicated with each other to enable the plate 210*a* adsorbed in the positioning groove 222*a* by the vacuum device 92.

In the same way, the plate 210*b* can be adsorbed in the positioning groove 222*b* by the vacuum device 92. The disclosure does not limit the above-mentioned fabrication method of the fixture 220*a* that a fixture is divided into two fixing modules, the apertures 226, the vacuum chamber 228 and the vacuum channel 229 are disposed at the two different fixing modules and then, the two fixing modules are joined to form the fixture 220*a*. In addition, when the vacuum device 92 is turned off, the plates 210*a* and 210*b* can be removed away from the positioning groove 222*a* and the positioning groove 222*b*, which the disclosure is not limited to. In other embodiments of the disclosure, the plates can be detachably disposed in the positioning grooves in other ways.

Figure 11:
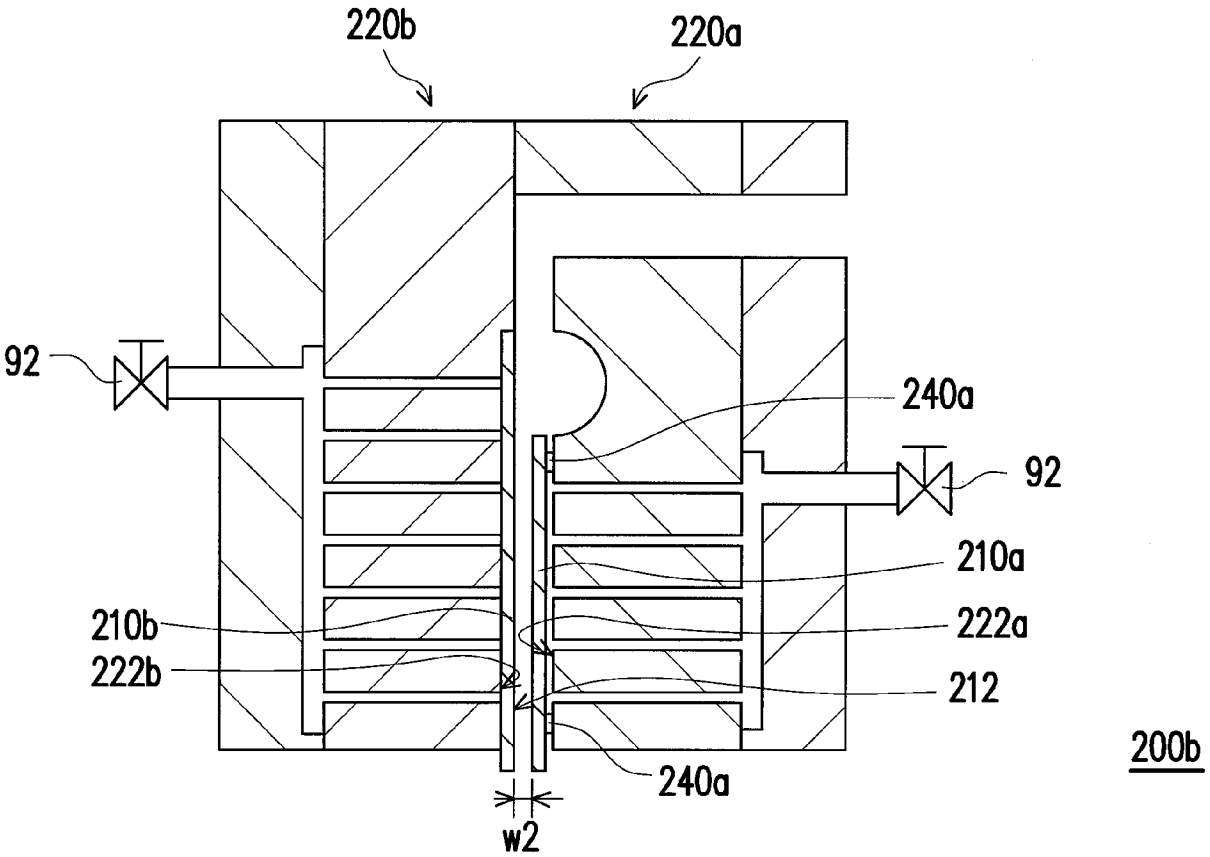
FIG. 11 is a cross-sectional diagram of a coating module according to yet another embodiment of the disclosure.

FIG. 11 is a cross-sectional diagram of a coating module according to yet another embodiment of the disclosure. In other embodiments of the disclosure, the fixtures 220*a* and 220*b* of a coating module 200*b* can have two elastic members 240*a* and 240*b* disposed respectively between the corresponding plate 210*a* and positioning groove 222*a* and between the corresponding plate 210*b* and positioning groove 222*b*, or the elastic member is disposed at one of the sides. In FIG. 11, only one elastic member 240*a* is disposed between the plate 210*a* and the positioning groove 222*a*, which the disclosure is not limited to. At the time, the elastic member 240*a* is disposed between the plate 210*a* and the positioning groove 222*a*.

When the vacuum device 92 respectively adsorbs the plates 210*a* and 210*b* into the corresponding positioning grooves 222*a* and 222*b*, the elastic force of the elastic member 240*a* makes the plate 210*a* not tight to the positioning groove 222*a*. Accordingly, once the coefficient of elasticity of the elastic member 240*a* is appropriate, the slot width w2 of the slot 212 can be adjusted. In addition, the disclosure does not limit the quantity of the elastic members and the quantity and the disposing positions of the elastic members in the coating module 200*b* can be selected depending on the requirement.

In the coating module 200 and 200*a* and 200*b*, the plates 210*a* and 210*b* can be fixed in the positioning grooves 222*a* and 222*b* and removed away from the positioning grooves 222*a* and 222*b*. When the plates 210*a* and 210*b* with higher surface smoothness get worn due to the flowing of the liquid molecules, the plates 210*a* and 210*b* can be removed away from the positioning grooves 222*a* and 222*b* and they are replaced by new plates 210*a* and 210*b*. At the time, to handle the surface wearing problem of the slot 212 in the coating module 200 or 200*a* or 200*b*, only the plates 210*a* and 210*b* need to be replaced without replacing the whole coating module 200 or 200*a* or 200*b*, which makes the coating module 200 and 200*a* and 200*b* have lower production cost and better reusability.

Figure 12:
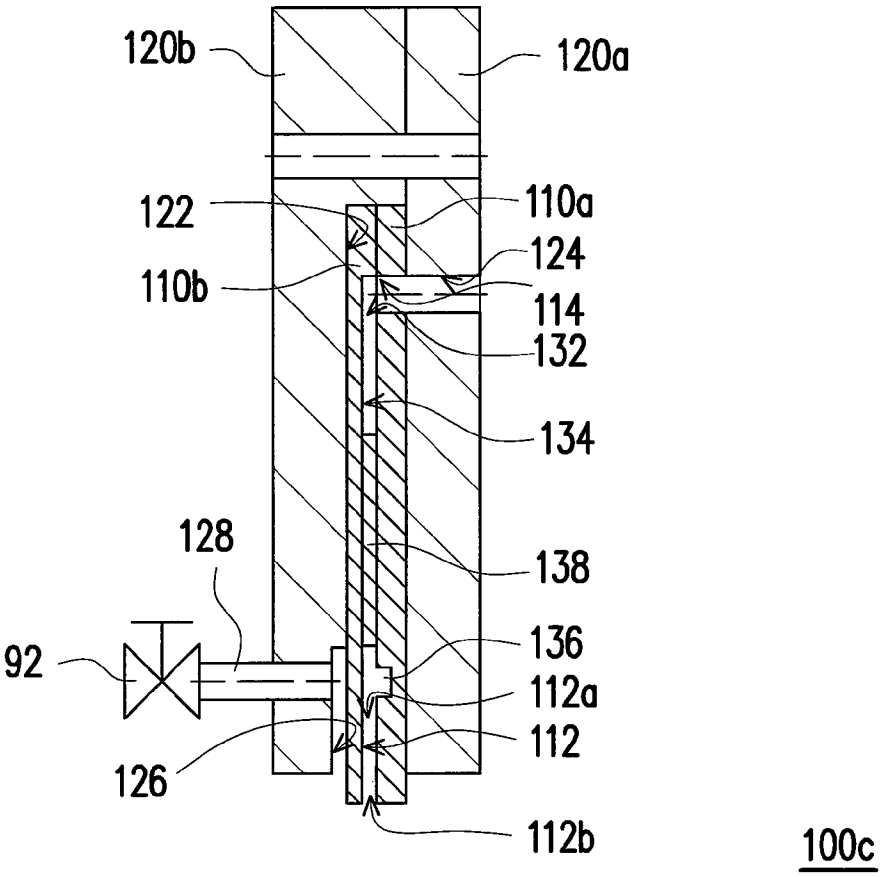
FIG. 12 is a cross-sectional diagram of the coating module according to yet another embodiment of the disclosure.

FIG. 12 is a cross-sectional diagram of the coating module according to yet another embodiment of the disclosure. Referring to FIG. 12, the major difference of the coating module 100*c* in the embodiment from the coating module 100*a* rests in that the coating module 100*c* further includes a vacuum chamber 126, located at fixture 120*b* and communicated with the fixing groove 122. The description of the structures and functions of the plates 110*a* and 110*b* and the fixtures 120*a* and 120*b* of the coating module 100*c* can refer the description about coating module 100*a* in FIG. 4A and FIG. 4B and FIG. 5.

In more details, the vacuum chamber 126 is communicated with the fixing groove 122 and correspondingly located near the slot outlet 112*b*. The vacuum chamber 126 is configured to be connected to the vacuum device 92. When the vacuum device 92 is operated, the region near the slot outlet 112*b* of the slot 112 form a vacuum state, so as to thin the liquid flowed out from the slot 112 via the slot outlet 112*b* and coated onto the substrate, but operating the vacuum device 92 or not does not limit thereto, the user can operate the vacuum device 92 according the needs.

Figure 13:
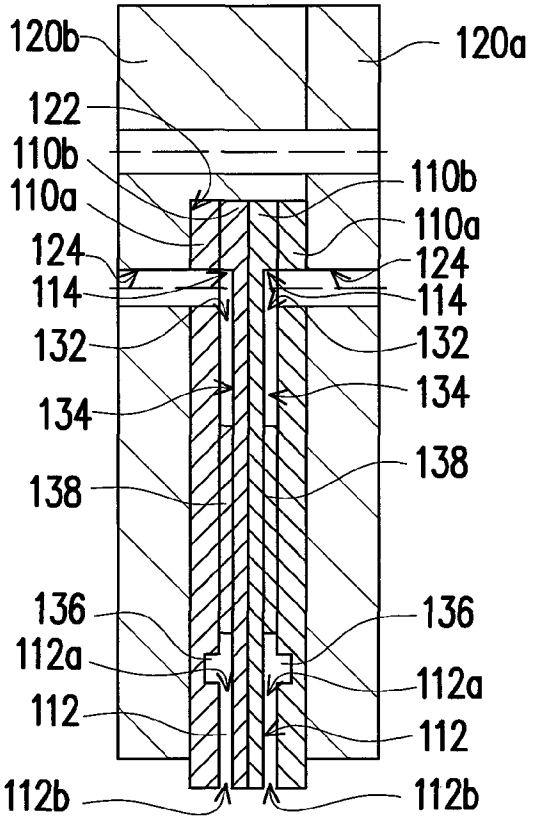
FIG. 13 is a cross-sectional diagram of the coating module according to yet another embodiment of the disclosure.

FIG. 13 is a cross-sectional diagram of the coating module according to yet another embodiment of the disclosure. Referring to FIG. 13, the major difference of the coating module 100*d* in the embodiment from the coating module 100*a* rests in that the coating module 100*d* includes two pairs of the plates 110*a* and 110*b*. The description of the structures and functions of the plates 110*a* and 110*b* and the fixtures 120*a* and 120*b* of the coating module 100*d* also can refer the description about coating module 100*a* in FIG. 4A and FIG. 4B and FIG. 5.

In more details, the two pairs of the plates 110*a* and 110*b* are detachably fixed in the fixing groove 122, and the fixtures 120*b* also has an injecting port 124. Each injecting port 124 goes through the fixture 120*a* and 120*b* and is corresponding to the injecting port 114 of each pair of the plates 110*a* and 110*b* respectively, so that the liquid is adapted to outflow from two slots 112 to be coated onto the substrate. More specifically, the liquid can be injected into the coating module 100*d* via the two injecting port 114, and then flow out of the coating module 100*d* from the slot outlets 112*b* through the slots 112 of the two pair of the plates 110*a* and 110*b*. As the result, the coating module 100*d* can coat two layers of liquid on the substrate, wherein the two layers of the liquid may be different material. Similarly, the coating module in other embodiment may includes multiple pairs of the plates 110*a* and 110*b* detachably fixed in the fixing groove 122, so as to coat multiple layers with different liquid on the substrate, and it does not limit thereto.

Therefore, when the plates 110*a* and 110*b* of the coating module 100*c* and 100*d* with higher surface smoothness get damage due to the flowing of the liquid molecules, the plates 110*a* and 110*b* can be removed away from the fixing groove 122 and they are replaced by new plates 110*a* and 110*b*. At the time, to handle the surface wearing problem of the slot 112 in the coating module 100*c* and 100*d*, only the plates 110*a* and 110*b* need to be replaced without replacing the whole coating module 100*c* and 100*d*, which makes the coating module 100*c* and 100*d* have lower production cost and better reusability.

In summary, in the coating module provided by the disclosure, there is a slot between two plates, and the slot has a slot inlet and a slot outlet. Two fixtures fix the plates and have an injecting port. The diversion structure makes the injecting port communicated with the slot inlet. The liquid can flow into the coating module via the injecting port, then flow into the slot via the diversion structure and the slot inlet, and then, outflow from the slot outlet so as to coat the liquid onto a substrate. In addition, the plates are detachably disposed in the grooves of the fixtures. When the surface of the slot gets worn, the plates can be removed away from the fixtures to replace the worn ones with new plates, without changing the whole coating module. In addition, the coating module can have different diversion structure depending on the requirement. In order to coat different liquid by the coating module and or to obtain different coating effects, the coating module is required to change the plates having different diversion structures only. Therefore, the coating module has higher adaptation, lower production cost and better reusability.

It will be apparent to those skilled in the art that the descriptions above are several preferred embodiments of the disclosure only, which does not limit the implementing range of the disclosure. Various modifications and variations can be made to the structure of the disclosure without departing from the scope or spirit of the disclosure. The claim scope of the disclosure is defined by the claims hereinafter.

What is claimed is:

1. A coating module, suitable for coating a liquid onto a substrate, comprising:

a planar slot consisting of: two plates, wherein the planar slot is constructed only by the two plates therebetween with two plane surfaces in parallel, an end of the slot has a slot inlet, the other end of the slot has a slot outlet, and one of the two plates has an injecting port, wherein the material of the two plates comprises silicon wafer or glass; and a curved diversion structure, connecting the injecting port and the slot inlet with at least one curved periphery from the injecting port to the planar slot, wherein the liquid is configured to enter the diversion structure via the injecting port, then uniformly flow to the slot inlet through the diversion structure, then flow into the slot via the slot inlet, and then uniformly outflow from the slot via the slot outlet, so that the liquid flows from a hole and disperses as a thin film through the curved diversion structure to directly form a thin film through the planar slot to be coated onto the substrate.

2. The coating module as claimed in claim 1, wherein the diversion structure comprises:

a diversion inlet, communicated with the injecting port;

a diversion channel, communicated with the diversion inlet; and a manifold, making the diversion channel communicated with the slot inlet, and the liquid is configured to uniformly flow to the slot inlet via the manifold.

3. The coating module as claimed in claim 2, wherein the diversion structure has a diversion pattern, and the diversion pattern is located on the diversion channel for guiding the liquid flowing on the diversion channel.

4. The coating module as claimed in claim 3, wherein the diversion pattern comprises a shunting island, and the shunting island is located at the slot outlet.

5. The coating module as claimed in claim 1, further comprising:

two fixtures, fixing the two plates between the two fixtures, wherein the injecting port is located on one of the two fixtures, and the diversion structure is formed by a part of one of the two fixtures and makes the injecting port communicated with the slot inlet.

6. The coating module as claimed in claim 5, wherein each of the two fixtures has a positioning groove, and the two plates are detachably disposed in the positioning grooves to form the slot.

7. The coating module as claimed in claim 6, wherein each of the two fixtures has a plurality of apertures, a vacuum chamber and a vacuum channel, the apertures are located on the positioning grooves and communicated with the vacuum chamber, the vacuum chamber is communicated with the vacuum channel, and the vacuum channel is configured to be connected to a vacuum device and respectively adsorb the two plates through the vacuum device into the positioning grooves so as to form the slot.

8. The coating module as claimed in claim 6, wherein each of the two fixtures has an elastic member, and each the elastic member is located between the corresponding plate and the corresponding positioning groove for adjusting the width of the slot.

9. The coating module as claimed in claim 1, wherein the diversion structure is formed by a part of one of the two plates or formed together by parts of the two plates, and the diversion structure makes the injecting port communicated with the slot inlet.

10. The coating module as claimed in claim 9, wherein one of the two plate with the diversion structure is a micromachined plate.

11. The coating module as claimed in claim 9, further comprising:

two fixtures, fixing the two plates between the two fixtures, wherein one of the two fixtures has a fixing groove, and the two plates are detachably fixed in the fixing groove.

12. The coating module as claimed in claim 11, further comprising:

a sealing cushion, located between one of the two plates and the corresponding one of the two fixtures.

13. The coating module as claimed in claim 11, wherein material of one of the two plates and the corresponding fixture thereof is transparent material to observe the flow of the liquid in the diversion structure.

14. The coating module as claimed in claim 11, further comprising:

a vacuum chamber, located at one of the two fixtures and communicated with the fixing groove, wherein the vacuum chamber is configured to be connected to a vacuum device to form a vacuum state at the slot outlet.

15. The coating module as claimed in claim 11, wherein two pairs of the two plates are detachably fixed in the fixing groove, so that the liquid is adapted to outflow from the slots via the slot outlets to be coated onto the substrate.

* * * * *